US008355646B2

(12) United States Patent
Nishizawa

(10) Patent No.: US 8,355,646 B2
(45) Date of Patent: Jan. 15, 2013

(54) OPERATIONS-UNIT ANGLE ADJUSTING DEVICE AND IMAGE FORMING APPARATUS

(75) Inventor: Yoshiharu Nishizawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 810 days.

(21) Appl. No.: 12/271,021

(22) Filed: Nov. 14, 2008

(65) Prior Publication Data

US 2009/0142095 A1 Jun. 4, 2009

(30) Foreign Application Priority Data

Dec. 3, 2007 (JP) ..... 2007-312695

(51) Int. Cl.
*G03G 15/00* (2006.01)

(52) U.S. Cl. ..... 399/81; 399/126; 220/264; 220/832

(58) Field of Classification Search ..... 399/75, 399/81, 107, 114, 126, 411; 220/260, 262–264, 220/810, 831–834
See application file for complete search history.

(56) References Cited

U.S. PATENT DOCUMENTS

2006/0219852 A1* 10/2006 Kawai et al. ..... 248/213.1
2006/0230689 A1* 10/2006 Asakawa ..... 52/32
2007/0177892 A1* 8/2007 Ikebata ..... 399/107
2008/0062444 A1* 3/2008 Sugawara et al. ..... 358/1.9

FOREIGN PATENT DOCUMENTS

| | | |
|---|---|---|
| JP | 2003-246114 | 9/2003 |
| JP | 2004-170660 | 6/2004 |
| JP | 2006-255979 | 9/2006 |

* cited by examiner

*Primary Examiner* — Walter L Lindsay, Jr.
*Assistant Examiner* — Benjamin Schmitt
(74) *Attorney, Agent, or Firm* — Oblon, Spivak, McClelland, Maier & Neustadt, L.L.P.

(57) ABSTRACT

Disclosed is an operations-unit angle adjusting device having an operations unit supported so as to freely move in a vertical direction and an adjusting mechanism that changes the vertical angle of the operations unit. The adjusting mechanism has a shaft part that supports the operations unit so as to freely move in the vertical direction, an operating lever that is supported so as to freely move in the vertical direction, and an opening/closing piece that operates simultaneously with vertical movements of the operating lever to perform an opening/closing operation. The opening/closing piece has an engaging part that is engaged with an engaged part provided in the apparatus main body to restrict vertical movements of the operations unit when the opening/closing piece is closed and that is disengaged from the engaged part to allow the vertical movements of the operations unit when the opening/closing piece is opened.

5 Claims, 5 Drawing Sheets

OPERATIONS-UNIT ANGLE ADJUSTING DEVICE AND IMAGE FORMING APPARATUS

BACKGROUND OF THE INVENTION

1. Field of the Invention

The present invention relates to image forming apparatuses such as electrophotographic copiers, facsimile machines, printers, plotters, and printing machines and, more specifically, to an improvement in the swing mechanism of an operations unit that operates the apparatuses.

2. Description of the Related Art

In conventional image forming apparatuses such as electrophotographic copiers, facsimile machines, printers, plotters, and printing machines, an operations unit (operations panel) is generally fixed to the exterior panel of an apparatus main body so as to be inclined at a predetermined angle in consideration of the line of sight, operability, etc., of average height users during use. In the display part of the fixed operations unit for various displays, however, visibility becomes poor due to reflections, etc., of interior light. In another aspect, wheelchair users are playing increasingly important roles in society, but the above image forming apparatus has generally the operations unit at its top surface. Therefore, the position of the operations unit is too high for the wheelchair users to operate the operations unit. In view of these problems, Patent Document 1 and Patent Document 2 disclose an image forming apparatus in which the operations unit is configured to be freely swung in a vertical direction with respect to the exterior panel of the apparatus main body and which has a holding unit that holds the operations unit at an appropriate angle so as to maintain a desired angle even if any external force is applied to the operations unit.

However, according to the technique disclosed in Patent Document 1, when the user moves the operations panel up, he/she is required to press a canceling switch with one hand and at the same time hold the operations panel with the other hand. That is, both hands of the user become full, which results in inconvenience for operations. When the user moves the operations panel down, he/she just presses the canceling switch with one hand to cause the operations panel to start moving down due to its own weight. However, in order to prevent the operations panel from moving down more than necessary or the occurrence of unforeseen accidents, the user is required to hold the operations panel with the other hand, which also results in both hands of the user being full.

On the other hand, according to the technique disclosed in Patent Document 2, both hands of the user do not become full when he/she moves the operations panel up and down unlike the technique disclosed in Patent Document 1. However, in order to cancel the lock mechanism of the operations panel, the user is required to pull an operating lever toward him/her and vertically move the operations panel in this state. As a result, when the vertical movement angle of the operations panel is increased, user operability is degraded.

Patent Document 1: JP-A-2006-255979

Patent Document 2: JP-A-2003-246114

SUMMARY OF THE INVENTION

Accordingly, the present invention may provide an operations-unit angle adjusting device that allows the user to vertically move an operations panel with one hand, provides excellent operability even if the vertical movement angle of the operations panel is increased, and ensures the vertical movement of the operations panel in a safe manner. In addition, the present invention may provide an image forming apparatus having the operations-unit angle adjusting device.

According to an aspect of the present invention, there is provided an operations-unit angle adjusting device having an operations unit that is supported by an apparatus main body so as to freely move in a vertical direction and an adjusting mechanism that changes a vertical angle of the operations unit. The adjusting mechanism has a shaft part that is provided on the side of the apparatus main body and supports the operations unit so as to freely move in the vertical direction, an operating lever that is supported by the operations unit so as to freely move in the vertical direction, and an opening/closing piece that operates simultaneously with vertical movements of the operating lever to perform an opening/closing operation. The opening/closing piece has an engaging part that is engaged with an engaged part provided in the apparatus main body to restrict vertical movements of the operations unit when the opening/closing piece is closed and that is disengaged from the engaged part to allow the vertical movements of the operations unit when the opening/closing piece is opened.

Preferably, the opening/closing piece may be supported by the operations unit so as to freely rotatably move in a lateral direction at an intermediate part and urged in a closing direction by an elastic member at all times, and the operating lever may have a cam part that engages with an actuation part provided at a front part of the opening/closing piece, the actuation part being slid along the cam part to rotatably move the opening/closing piece in an opening/closing direction when the operating lever is moved vertically.

Preferably, the engaged part may refer to plural engaged holes provided in a bracket, and the engaging part may refer to an engaging projection that is fitted and engaged with any of the engaged holes.

Preferably, the operations-unit angle adjusting device may further has a movement suppressing member that suppresses movement of the operations unit.

Preferably, the operations-unit angle adjusting device may further has a restriction unit that restricts movements of the opening/closing piece.

According to another aspect of the present invention, there is provided an image forming apparatus having the operations-unit angle adjusting device as described above.

According to an embodiment of the present invention, the operations unit can be easily moved vertically only by the movement of the operating lever in a desired direction.

Furthermore, the restriction of the vertical movements of the operations unit is released even when the operating lever is moved in any of upward and downward directions. Therefore, the user is not required to move the operations unit with his/her both hands full or while pulling the operating lever, which results in convenience for operations.

Other objects, features and advantages of the present invention will become more apparent from the following detailed description when read in conjunction with the accompanying drawings.

BRIEF DESCRIPTION OF THE DRAWINGS

FIGS. 3A and 3B are enlarged views of a substantial part of FIG. 2, wherein FIG. 3A shows a status in which vertical movements of an operations unit are restricted and FIG. 3B shows a status in which the vertical movements thereof are allowed; and FIGS. 4A through 4C are cross-sectional views of the operations-unit angle adjusting device according to the embodiment of the present invention as viewed from the front side of an apparatus main body, wherein FIG. 4A shows a status in which an operating lever is not operated, FIG. 4B shows a state in which the operating lever is moved up, and FIG. 4C shows a state in which the operating lever is moved down.

DETAILED DESCRIPTION OF THE PREFERRED EMBODIMENTS

Next, an embodiment of the present invention is described in detail.

Figure 1:
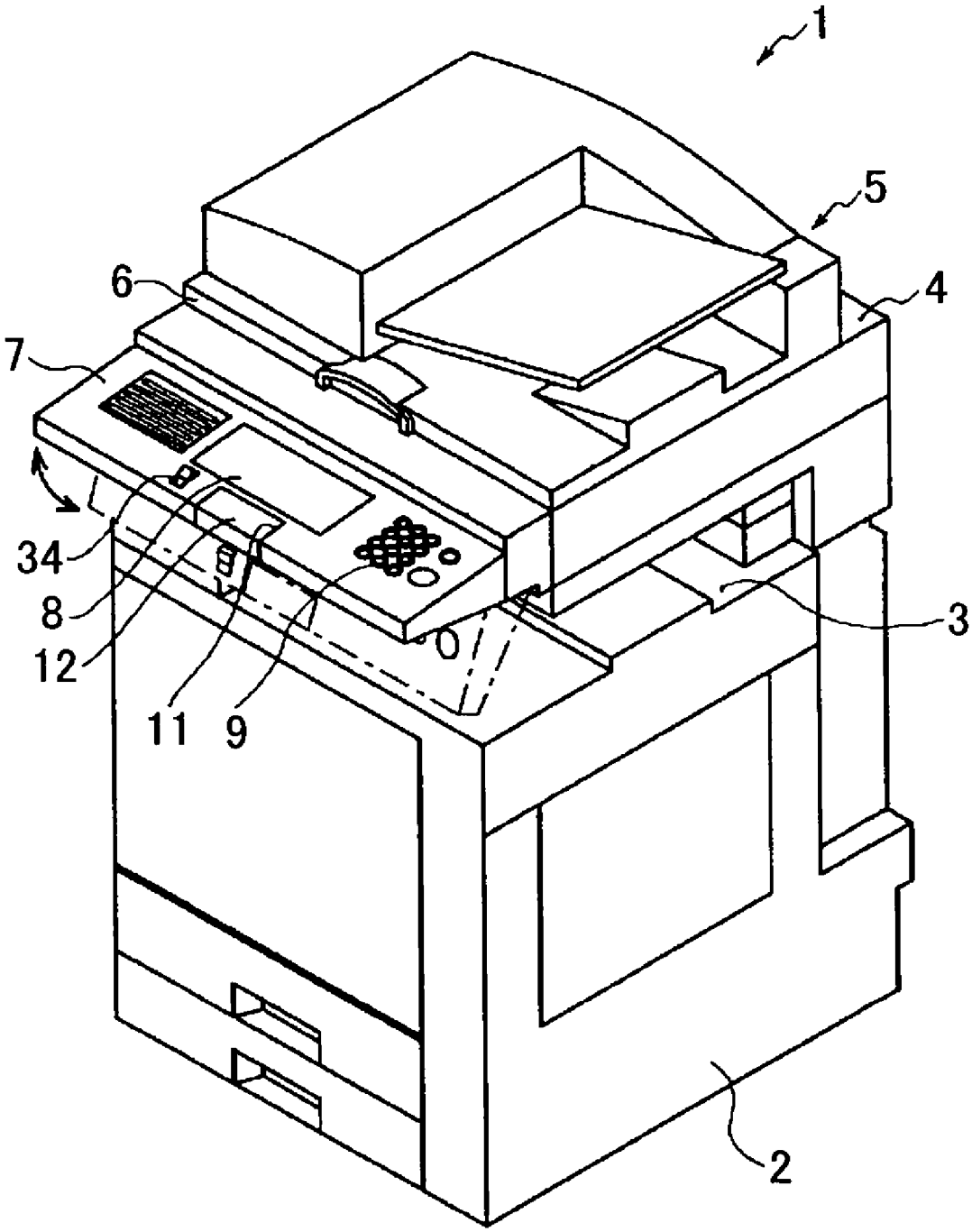
FIG. 1 is a view showing an entire image forming apparatus according to an embodiment of the present invention.

FIG. 1 is a view showing an entire image forming apparatus according to the embodiment of the present invention. An electrophotographic image forming apparatus 1 has a photosensitive drum, a development device, a transfer device, a fixing device, an optical writing device, etc., each of which is not shown in FIG. 1, inside an apparatus main body 2. A transfer sheet on which an image is formed in the apparatus main body 2 is ejected from a sheet ejection tray 3. On the apparatus main body 2, an image scanning unit 4 having a contact glass not shown and an ADF (Automatic Document Feeder) 5 that automatically feeds a document are provided. The ADF 5 is incorporated in a cover 6 that is freely opened and closed with respect to the contact glass.

On the upper front side of the apparatus main body 2, an operations unit 7 that operates the image forming apparatus 1 is provided. On the top surface of the operations unit 7, a display device 8 and various keys 9 are arranged. The operations unit 7 according to the embodiment of the present invention can be vertically moved with respect to the apparatus main body 2. Inside the operations unit 7, an adjusting mechanism 10 (see FIG. 2) that changes the vertical angle of the operations unit 7 is provided. Furthermore, in an concave part 11 provided at the front edge of the operations unit 7, an operating lever 12 that vertically moves the operations unit 7 is provided so as to be swung in a vertical direction.

Figure 2:
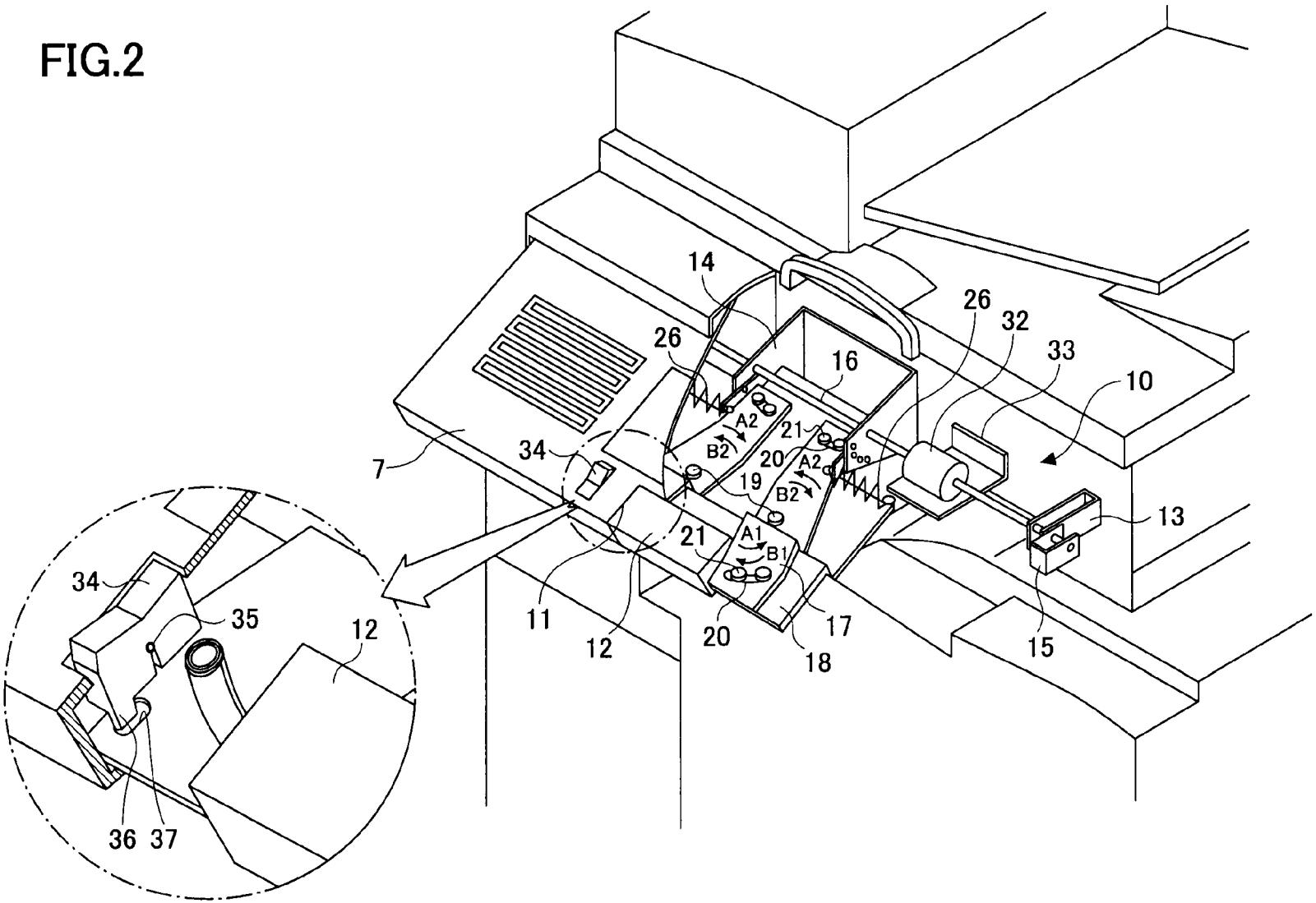
FIG. 2 is a perspective view showing the structure of an operations-unit angle adjusting device according to the embodiment of the present invention.
Figure 3A:
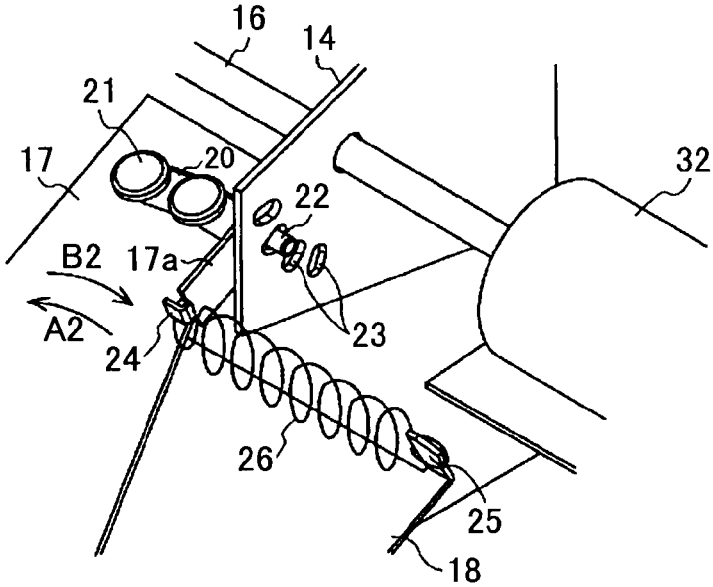
Figure 3B:
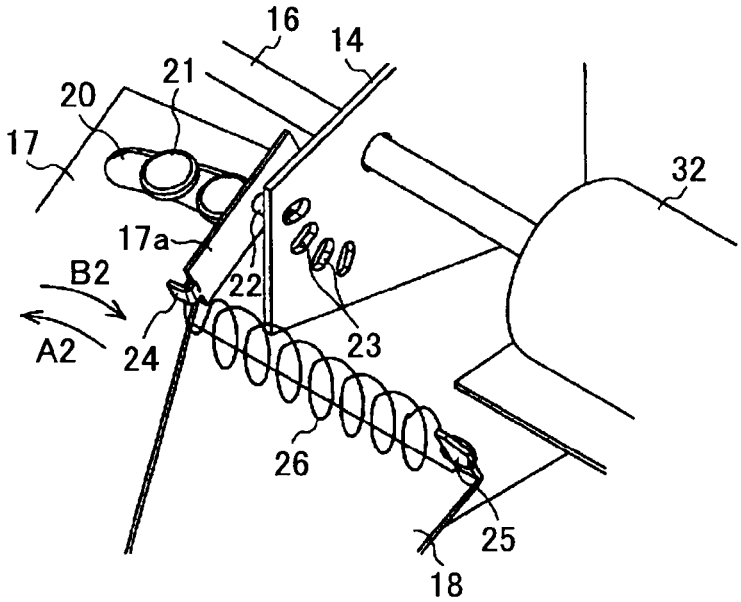

Here, a description is made of the configuration of an operations-unit angle adjusting device according to the embodiment of the present invention. FIG. 2 is a perspective view showing the structure of the operations-unit angle adjusting device according to the embodiment of the present invention. FIGS. 3A and 3B are enlarged views of a substantial part of FIG. 2, wherein FIG. 3A shows a status in which vertical movements of the operations unit 7 are restricted and FIG. 3B shows a status in which the vertical movements thereof are allowed.

The operations-unit angle adjusting device according to the embodiment of the present invention has the operations unit 7 and the adjusting mechanism 10 that changes the vertical angle of the operations unit 7 inside the operations unit 7.

A pair of bearing members 13 that support a horizontal shaft 16 and a main-body-side bracket 14 are fixed to the apparatus main body 2. Furthermore, a pair of bearing members 15 that support the horizontal shaft 16 are fixed to the operations unit 7. The operations unit 7 is supported to the apparatus main body 2 by the bearing members 13, the main-body-side bracket 14, and the horizontal shaft 16 inserted into the bearing members 15 so as to freely move in the vertical direction.

Inside the operations unit 7, an opening/closing piece 17 that operates simultaneously with the operations of the operating lever 12 is provided so as to extend from the side of the operating lever 12 to the main-body-side bracket 14. The opening/closing piece 17 is supported by a rotating shaft 19 provided at an operations-unit-side bracket 18 of the operations unit 7 and rotates laterally about the rotating shaft 19 on the operations-unit-side bracket 18. In addition, the opening/closing piece 17 has an arc-shaped long guiding hole 20. The opening/closing piece 17 is projected from the operations-unit-side bracket 18, and a rivet 21 passes through the long guiding hole 20. With the rivet 21 and the long guiding hole 20, the vertical movements of the opening/closing piece 17 are restricted during use, and the opening/closing piece 17 is guided so as to smoothly rotate.

As shown in FIGS. 3A and 3B, on the side of the main-body-side bracket 14, the opening/closing piece 17 has a rising piece 17*a* parallel to the inner wall of the main-body-side bracket 14 and an engaging projection 22 as an engaging part projected from the rising piece 17*a*. The engaging projection 22 selectively fits in plural engaged holes 23 as engaged parts provided in the main-body-side bracket 14 to restrict the vertical movements of the operations unit 7. Furthermore, as shown in FIGS. 3A and 3B, a coil spring 26 as an elastic member is hooked at a claw-shaped projection 24 provided on the side of the main-body-side bracket 14 of the opening/closing piece 17 and at a claw-shaped projection 25 of the operations-unit-side bracket 18. The coil spring 26 urges the engaging projection 22 in a direction so as to fit in the engaged hole 23, namely, it urges the opening/closing piece 17 in a direction so as to be closed at all times.

Figure 4A:
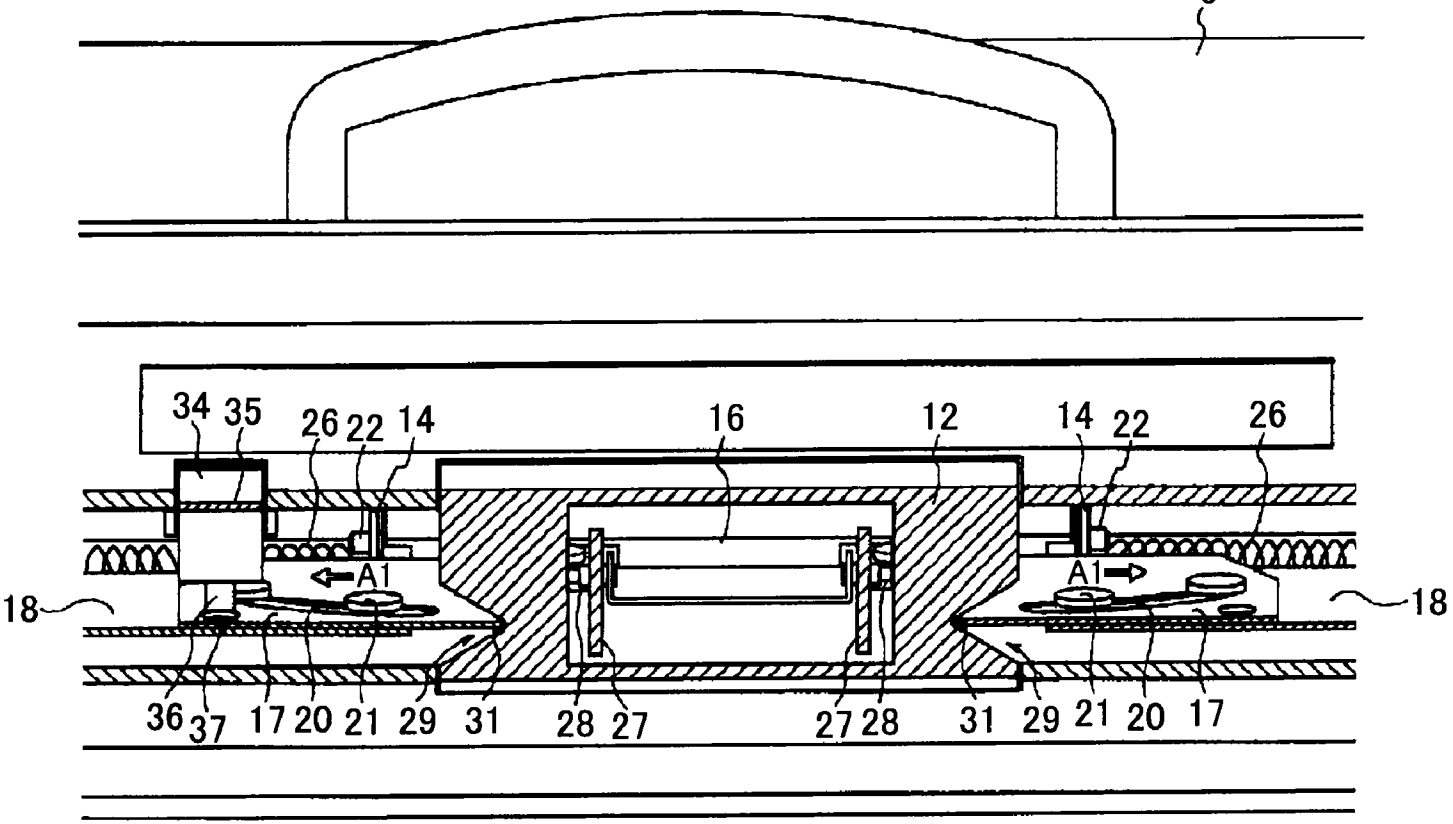
Figure 4B:
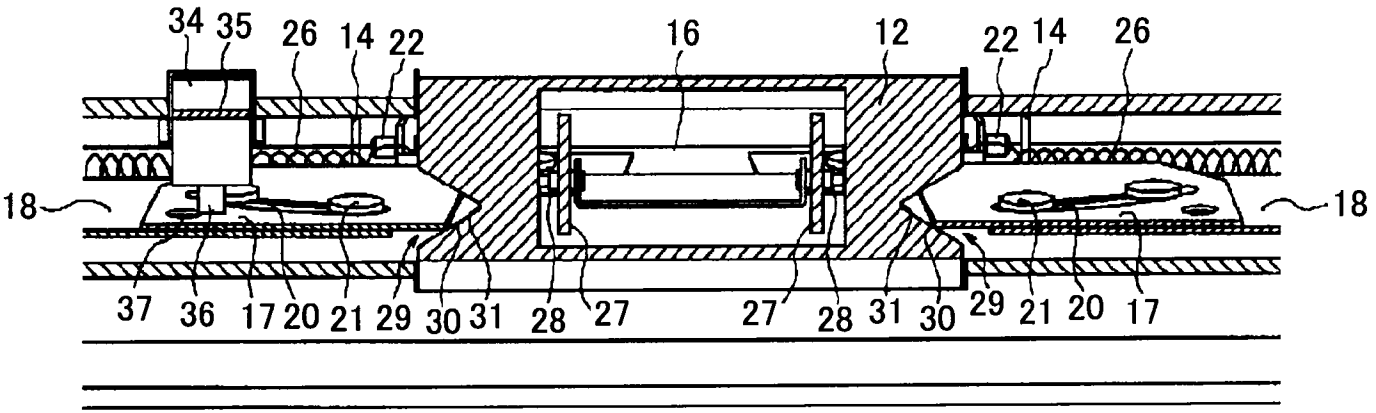
Figure 4C:
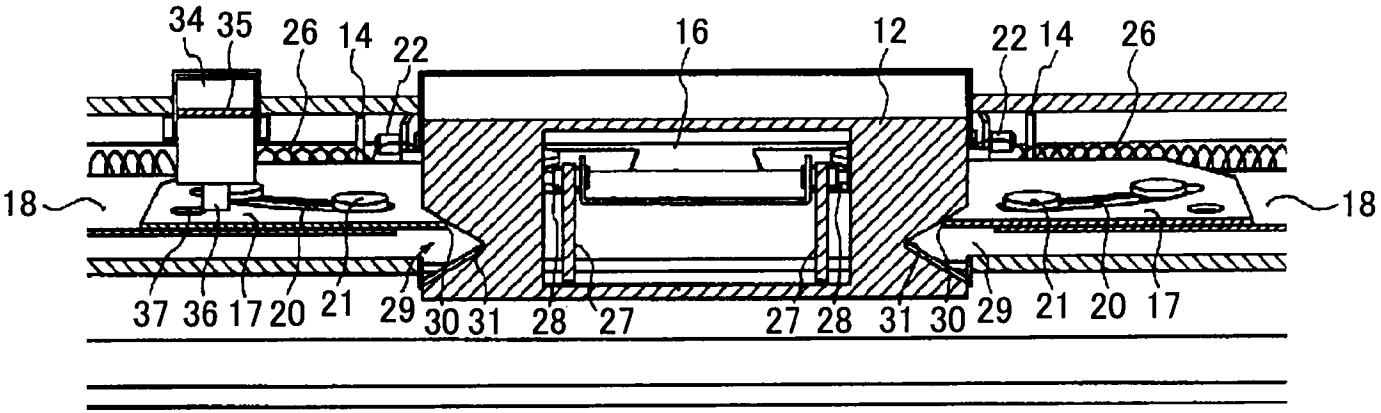

FIGS. 4A through 4C are cross-sectional views of the operations-unit angle adjusting device according to the embodiment of the present invention as viewed from the front side of the apparatus main body 2, wherein FIG. 4A shows a status in which the operating lever 12 is not operated, FIG. 4B shows a state in which the operating lever 12 is moved up, and FIG. 4C shows a state in which the operating lever 12 is moved down.

The operating lever 12 is supported to the operations unit 7 by a supporting shaft 28 through bearing members 27 so as to freely rotate in the vertical direction. In addition, the operating lever 12 has a cam part 29 that causes the opening/closing piece 17 to operate simultaneously with the vertical movements when the operating lever 12 is manipulated. The cam part 29 is in the form of a V-shaped notch and engages with an actuation part 30 provided on the side of the operating lever 12 of the opening/closing piece 17. The notch of this embodiment has a V-shape, but the shape of the notch is not particularly limited to a V-shape so long as it allows the notch to engage with the actuation part 30 to operate the opening/closing piece 17.

Next, a description is made of the operations of the operations-unit angle adjusting device configured as described above.

When the operating lever 12 is not operated, namely, when it is in an initial state shown in FIG. 4A, the engaging projection 22 is engaged with the engaged hole 23 by the urging force of the coil spring 26. Furthermore, the urging force of the coil spring 26 is transmitted to the operating lever 12 through the opening/closing piece 17, which causes the actuation part 30 to come into contact with a deepest tapered part 31 of the cam part 29 to achieve a balance therewith.

When the operating lever 12 is moved up in this state, it rotates upward about the supporting shaft 28 with respect to the operations unit 7. Then, the cam part 29 moves upward, which in turn causes the actuation part 30 of the opening/closing piece 17 engaging with the cam part 29 to be pressed. Accordingly, a contact position between the tapered notch of the cam part 29 and the actuation part 30 is caused to move along the notch, and the actuation part 30 is caused to move in a direction as indicated by an arrow A1. Here, the opening/closing piece 17 is guided so as to move in a horizontal direction through the long guiding hole 20 and the rivet 21 of the actuation part 30, and movements in the vertical direction are restricted. Therefore, the opening/closing piece 17 does not move vertically together with the vertical movements of the operating lever 12. The opening/closing piece 17 moves in the horizontal direction while maintaining the engagement with the cam part 29 at the tapered part 31.

The engaging projection 22 of the opening/closing piece 17 moves in a direction as indicated by an arrow A2 about the rotating shaft 19, which in turn releases the engagement of the engaging projection 22 with the engaged hole 23 and makes it possible for the operations panel to freely move in the vertical direction. Note that even if an excessive force is applied to the operations panel in a state in which the engagement of the engaging projection 22 with the engaged hole 23 is not completely released, the opening/closing piece 17 is guided so as to move in the horizontal direction by the long guiding hole 20 and the rivet 21 on the side of the engaging projection 22. In other words, because the movements of the opening/closing piece 17 in the vertical direction are restricted, the operations unit 7 does not move vertically until the engagement is completely released.

When the pressing of the operations unit 7 is continued through the operating lever 12 in a state in which the engagement of the engaging projection 22 with the engaged hole 23 is released, the operations unit 7 can be moved upward. When the user moves his/her hand off the operating lever 12 after establishing a desired angle of the operations unit 7, the engaging projection 22 of the opening/closing piece 17 is caused to move in the direction as indicated by an arrow B2 by the urging force of the coil spring 26. Accordingly, the engaging projection 22 is caused to engage with the engaged hole 23 to fix the operations panel.

Furthermore, when the operating lever 12 is moved down, it rotates downward about the supporting shaft 28 with respect to the operations unit 7. Then, the cam part 29 moves downward, which in turn causes the actuation part 30 of the opening/closing piece 17 engaging with the cam part 29 to be pressed. Accordingly, the actuation part 30 is caused to move in the direction as indicated by an arrow A1 along the tapered notch of the cam part 29. The following operations are the same as those when the operating lever 12 is pressed upward, by which the operations panel can be moved downward. When the user moves his/her hand off the operating lever 12 after establishing a desired angle of the operations unit 7, the engaging projection 22 of the opening/closing piece 17 is caused to move in the direction as indicated by an arrow B2 by the urging force of the coil spring 26. Accordingly, the engaging projection 22 is caused to engage with the engaged hole 23 to fix the operations panel.

As described above, the cam part 29 has the tapered notch in the operations-unit angle adjusting device according to the embodiment of the present invention. Therefore, the engagement of the engaging projection 22 of the opening/closing piece 17 can be released when the operating lever 12 is moved upward and downward. Accordingly, a special operation for pulling the operating lever 12 in advance to release the engagement is not required when the operations unit 7 is moved vertically. In addition, the operations unit 7 can be moved only by the movement of the operating lever 12 in a desired direction. As a result, it is possible to provide the operations-unit angle adjusting device and the image forming apparatus that allows the user to intuitively learn the operations.

According to the first embodiment of the present invention, the initial position of the operating lever 12 is stably maintained by the urging force of the coil spring 26. However, in order to maintain the initial position of the operating lever 12, other elastic members may be provided instead of the coil spring 26. For example, a torsion coil spring is inserted into the supporting shaft 28 so as to hook its one end at the bearing member 27 and other end at an appropriate position of the operations unit 7. With this configuration, it is also possible to maintain the initial position of the operating lever 12.

In addition, the tapered shape of the cam part 29 is not limited to a straight line as shown in FIGS. 4A through 4C, but it may be a curve. In other words, the shape may be any type so long as it is capable of pressing the opening/closing piece 17 in the horizontal direction when the operating lever 12 is moved vertically.

Next, a second embodiment of the present invention is described. In the first embodiment having the basic configuration of the present invention, the operations unit 7 is caused to move down due to its own weight in a state in which the engagement of the engaging projection 22 is released. As a result, the apparatus may be broken due to an impact applied to the operations unit 7, or the user may be injured when the operations unit 7 suddenly moves down. In view of the problem, this embodiment provides the operations-unit angle adjusting device having a movement suppressing member that suppresses the movements of the operations unit 7 for safe operations, and the image forming apparatus having this operations-unit angle adjusting device.

As shown in FIG. 2, a roller 32 made of a rubber or the like is inserted and fixed to the horizontal shaft 16, a plate spring 33 partially fixed to the apparatus main body 2 is pressure-welded to the peripheral surface of the roller 32, and the plate spring 33 is braked by its own urging force. Because the plate spring 33 is pressure-welded to the roller 32, rotational resistance is generated between the roller 32 and the plate spring 33 by a frictional force caused when the operations unit 7 is moved vertically. As a result, the vertical movements of the operations unit 7 are suppressed.

Settings of the rotational resistance can be considered in many ways. For example, if the rotational resistance to such an extent that the operations unit 7 does not move down due to its own weight is generated, the position of the operations unit 7 is maintained even in a state in which the engagement of the engaging projection 22 is released, which can prevent the operations unit 7 from suddenly moving down. Furthermore, if the rotational resistance to such an extent that the operations unit 7 gently moves down due to its own weight is generated, the operations unit 7 moves down in a state in which the engaging projection 22 is in contact with the main-body-side bracket 14. This allows the engaging projection 22 to automatically fit in and engage with the engaged hole 23.

Moreover, a one-way clutch (not shown) that serves only in a direction in which the operations unit 7 naturally falls due to its own weight is incorporated in the roller 32. With this configuration, the operations unit 7 can be lightly moved in a direction in which the one-way clutch does not serve, namely, in an upward direction because the horizontal shaft 16 and the roller 32 run idle to cause no load. As a result, operability can be further improved.

Note that in this embodiment, the plate spring 33, the roller 32, and the one-way clutch are used as the movement suppressing members. The movement suppressing member is not particularly limited to the embodiment, but it may be any type so long as it suppresses the moving-down of the operations unit 7 due to its own weight.

As described above, according to the second embodiment of the present invention, the vertical movements of the operations unit 7 due to its own weight are restricted. Therefore, because the operations unit 7 is swung according to user's purposes, operations can be performed in a safe manner.

Next, a third embodiment of the present invention is described based on FIG. 2. According to this embodiment, a restriction unit that restricts the movements of the opening/closing piece 17 is provided so as to improve further safeness. As shown in the enlarged view of FIG. 2, the restriction unit is composed of a switch 34, a supporting shaft 35, an engaging projection 36, and an engaged hole 37.

The switch 34 is supported to the operations unit 7 by the supporting shaft 35 so as to freely rotate. The opening/closing piece 17 has the engaged hole 37 that restricts the opening operation of the opening/closing piece 17 in such a manner that the engaging projection 36 of the switch 34 is engaged and fitted.

FIG. 2 shows a status in which the engaging projection 36 fits in the engaged hole 37. In this state, the opening operation of the opening/closing piece 17 is restricted. As a result, even if the operating lever 12 is moved, the fitting of the engaging projection 22 of the opening/closing piece 17 with the engaged hole 23 of the main-body-side bracket 14 is maintained. Therefore, the vertical movements of the operations unit 7 are restricted.

As described above, according to the third embodiment of the present invention, the unit that restricts or releases the movements of the opening/closing piece 17 is provided. Therefore, a risk caused when the user erroneously operates the operating lever 12 can be avoided.

The present invention is not limited to the specifically disclosed embodiments, and variations and modifications may be made without departing from the scope of the present invention.

The present application is based on Japanese Priority Application No. 2007-312695 filed on Dec. 3, 2007, the entire contents of which are hereby incorporated herein by reference.

What is claimed is:

1. An operations-unit angle adjusting device comprising:

an operations unit that is supported by an apparatus main body so as to freely move in a vertical direction; and an adjusting mechanism that changes a vertical angle of the operations unit, wherein the adjusting mechanism has a shaft part that is provided on a side of the apparatus main body and supports the operations unit so as to freely move in the vertical direction, an operating lever that is supported by the operations unit so as to freely move in the vertical direction, the operating lever moving the operations unit in a same direction as the operating lever, and an opening/closing piece that operates simultaneously with vertical movements of the operating lever to perform an opening/closing operation, the opening/closing piece having an engaging part that is engaged with an engaged part provided in the apparatus main body to restrict vertical movements of the operations unit when the opening/closing piece is closed and that is disengaged from the engaged part to allow the vertical movements of the operations unit when the opening/closing piece is opened, wherein the opening/closing piece is supported by the operations unit so as to freely rotatably move in a lateral direction at an intermediate part and urged in a closing direction by an elastic member at all times, and the operating lever includes a cam part with a symmetrically shaped notch that engages with an actuation part provided at a frontpart of the opening/closing piece, the actuation part being slid along the symmetrically shaped notch in the cam part to rotatably move the opening/closing piece in an opening/closing direction when the operating lever is moved vertically.

2. The operations-unit angle adjusting device according to claim 1, wherein the engaged part refers to plural engaged holes provided in a bracket, and the engaging part refers to an engaging projection that is fitted and engaged with any of the engaged holes.

3. The operations-unit angle adjusting device according to claim 1, further comprising:

a movement suppressing member that suppresses movement of the operations unit.

4. The operations-unit angle adjusting device according to claim 1, further comprising:

a restriction unit that restricts movements of the opening/closing piece.

5. An image forming apparatus having the operations-unit angle adjusting device according to claim 1.

* * * * *